US005621931A

United States Patent [19]

Hamilton

[11] Patent Number: 5,621,931

[45] Date of Patent: Apr. 22, 1997

[54] MATTRESS STABILIZING BEDSKIRT ASSEMBLY HAVING DETACHABLY ATTACHABLE SKIRT COMPONENTS

[76] Inventor: Samantha Hamilton, 103 W. Casino Rd., #8, Everett, Wash. 98204

[21] Appl. No.: 697,194

[22] Filed: Aug. 21, 1996

Related U.S. Application Data

[63] Continuation-in-part of Ser. No. 570,777, Dec. 12, 1995, abandoned.

[51] Int. Cl.[6] ..... A47G 9/02

[52] U.S. Cl. ..... 5/493; 5/482; 5/923; 5/925

[58] Field of Search ..... 5/482, 486, 493, 5/488, 923, 925

[56] References Cited

U.S. PATENT DOCUMENTS

| | | | |
|---|---|---|---|
| 2,763,875 | 9/1956 | Piontkowski | 5/493 |
| 5,086,531 | 2/1992 | Carlos | 5/493 |
| 5,205,003 | 4/1993 | Green | 5/493 |
| 5,335,383 | 8/1994 | Schwind | 5/493 |
| 5,353,456 | 10/1994 | Evans | 5/493 |

*Primary Examiner*—Michael F. Trettel

[57] ABSTRACT

A bedskirt assembly made up of a non-slip grip deck made from non-slip fabric with releasable fasteners. The grip deck is installed between the mattress and box springs of the bed and stabilizes the location of the mattress relative to the box springs and provides for easy attachment of segments of skirting, in one panel or several panels. The position of the panels is adjustable for height and length and to suit individual bedframes. The skirt panels can be quickly and easily removed and replaced without having to remove the mattress from the box springs.

8 Claims, 6 Drawing Sheets

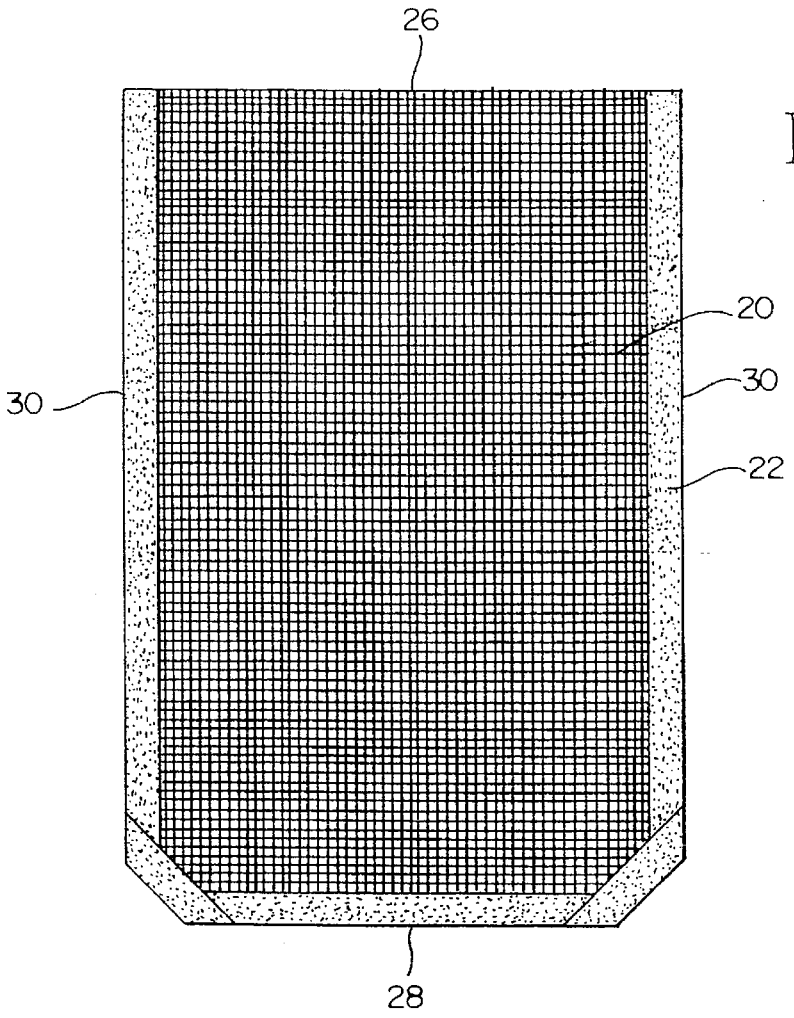
FIG. 2
FIG. 3
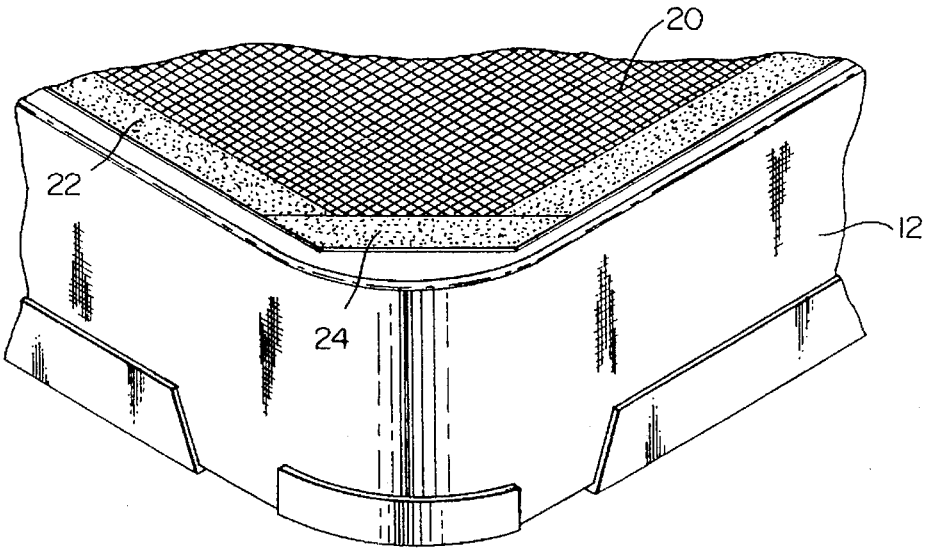

FIG. 6
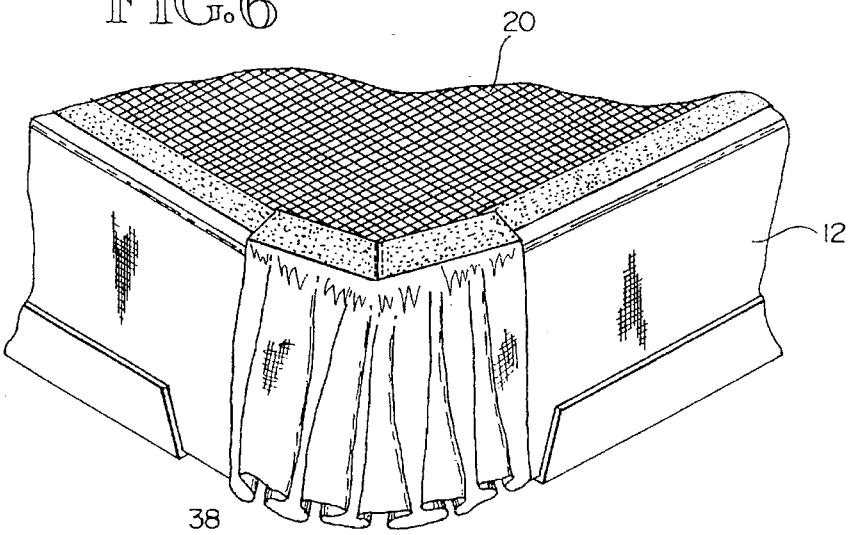
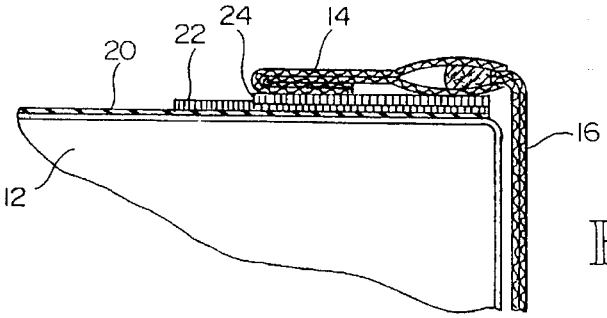
FIG. 5
FIG. 7
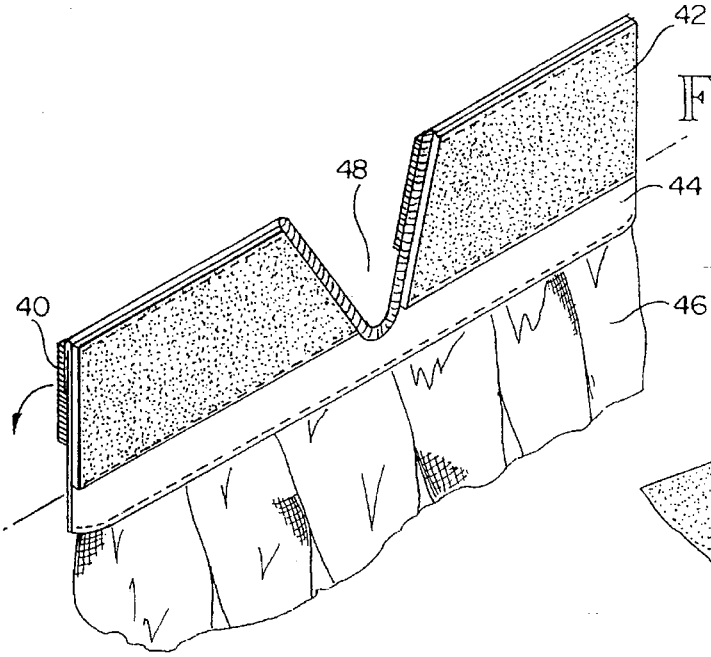
FIG. 7A
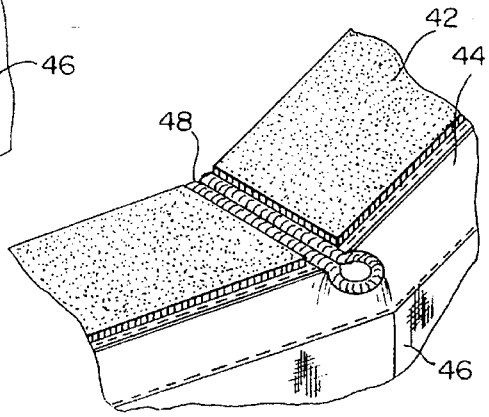

MATTRESS STABILIZING BEDSKIRT ASSEMBLY HAVING DETACHABLY ATTACHABLE SKIRT COMPONENTS

This application is a Continuation In Part of application Ser. No. 08/570,777, filed Dec. 12, 1995, now abandoned.

BACKGROUND—Field of Invention

This invention relates to box springs, mattresses and bedding, specifically a combination of elements which stabilize the mattress on top of the box springs while allowing the easy removal and replacement of the grip skirt panels (sometimes called a bedskirt or dust ruffle) for cleaning and decorating purposes,

BACKGROUND—Description of Prior Art

Bed skirts for beds (also sometimes called dust ruffles) have historically been permanently assembled assemblies created in one piece consisting of a flat sheeting material placed between the box springs and mattress, and skirting material permanently attached to the flat sheeting material. This arrangement is unsatisfactory because use of permanently-attached skirting materials requires one or more persons to remove the mattress in order to properly place and align the flat sheet and permanently attached skirting material, and then to replace and adjust the mattress on top without disturbing the bedskirt assembly. If the skirting becomes soiled, the arduous process of mattress removal and replacement has to be repeated. In addition to the problems associated with getting the skirting material into place, there is also the problem of the flat sheeting and permanently attached skirting material shifting and moving in between the mattress and box springs during normal use. Mattresses and box springs are covered with smooth-faced fabrics which promote instability between the mattress and box springs. Consequently, because all the fabrics involved have smooth surfaces, the flat sheeting material slips and slides in between the mattress and box springs causing the bed skirt to lose its alignment, again necessitating the removal of the mattress to again align the flat sheeting material and the permanently attached skirting.

Prior inventors have addressed the issue of removing and replacing the skirting by inventing systems where the skirt is attached separately to the flat sheet between the mattress and box springs. U.S. Pat. Nos. 5,335,383 to Schwind, 5,086,531 to Carlos, 5,205,003 to Green, 5,353,456 to Evans, and 2,763,875 to Piontkowski address the aspects of removing, re-attaching and/or adjusting the skirting material. However, none of the above inventions address the following problems:

(a) The problem of the mattress moving and shifting on top of the box springs after installation, thereby disturbing and upsetting the alignment of the flat sheeting material and consequently the attachable skirting material. The above-listed inventions do not address the problem of smooth-faced fabrics, including the flat sheeting material, and the fact that the flat sheeting material will shift and move during normal use, causing the attachable skirting to lose its alignment.

(b) The problem of using the weight of the mattress to hold the flat sheeting material in place between the mattress and box springs. Because the flat sheeting material and the mattress and box springs are all smooth surfaces, weight alone does not stabilize the flat sheeting material. The mattress still slides and shifts on top of the box springs and against the flat sheeting material, causing the flat sheeting material to shift and move, and causing the attachable skirting to lose its alignment.

(c) The problem of individual mattress and box spring sizes. Within each standard size category (twin, full, queen, king, and California king), mattress and box springs manufacturers have differing circumference measurements and differing corner shape designs—some are more rounded, some are more square. The variances between manufacturers and their mattresses and box springs may be small, but the above-listed patents have no allowance whatsoever for any variance in size or corner shape. The above-listed patents cannot provide a universal fit because they are based on the premise that all mattress measurements and corner curves will be identical within each standard size category, because there is no allowance for adjustments and the fit must be exact in order for the above inventions to be installed and achieve the proper esthetics.

(d) The problem of the accuracy needed in fitting hook and loop fasteners and/or snap fasteners to the flat sheeting material. Prior inventions have required a high degree of accuracy in the fasteners, i.e., the fasteners must match exactly and be placed completely on top of each other (in the case of hook and loop fasteners) and/or must be aligned precisely with each other (in the case of snaps or other fasteners). This is difficult, and frequently impossible, to do because of variations in mattresses and box springs. The requirement for accurate fastener component alignment limits adjustments for skirting height.

(e) The problem of different bedframe styles. The above-listed inventions do not easily adjust or adapt to bedframes with posts or footboards or any combination of posts and footboards. The skirting material cannot be easily adjusted to fit individual bed frames.

(f) The problem of deterioration of the woven fabric used in the flat sheet placed between the mattress and box springs. The flat sheet material used in the prior inventions will deteriorate rapidly from wear and tear because of the mattress slipping and sliding during normal use.

(g) The problem of mold and mildew of the woven fabric used in the flat sheet placed beneath a water-filled bladder (waterbed). The flat sheet material will deteriorate and become mildewed because cotton or cotton-type fabrics cannot be permanently protected from mold and mildew.

(h) The problem of spot-cleaning the skirting material. The one-piece skirting material construction shown in some of the above inventions necessitates removal and cleaning of the entire skirt, even if only one side or a small portion is soiled.

(i) The problem of warping on the flat-sheet material placed between the mattress and box springs caused by the hook and loop fasteners' inflexibility when forced around a dramatic corner or curve as shown in the above patents. This warping causes the skirting material to become unattached and misaligned.

OBJECTS AND ADVANTAGES

Several objects and advantages of the present invention are:

(a) Stabilizes the mattress on top of the box springs and avoid movements, slipping and sliding during use, thereby eliminating the all the problems caused by mattress movement;

(b) Construction and design of the grip deck between the mattress and box springs allows for individual variance in sizes of mattress and box springs;

(c) The materials used in the grip deck are antimicrobial, thereby resistant to fungi;

(d) Multiple-piece skirting material construction allows for variances and adjustment to individual mattress and box spring measurements;

(e) Multiple-piece skirting material construction allows for ease of cleaning and maintenance: only the soiled piece needs to be removed and replaced instead of the entire skirting material;

(f) Construction of the skirting material and the means for fastening it to the grip deck for adjustments to skirting height and circumference to fit all mattresses and box springs;

(g) Manufacture and use of the subject invention is more economical because the fasteners used between the grip deck and the grip skirt panels do not require an exact match or accuracy of alignment in order to attach the skirts.

Further objects and advantages are to provide an easy-to-manufacture item that can be mass produced at a reasonable cost to fit any style or type of mattress, box spring and bed frame arrangement. Still further objects and advantages will become apparent from a consideration of the ensuing description and drawings.

DRAWING FIGURES

In the drawings, closely related figures have the same number but different alphabetic suffices.

FIG. 2 shows a top plan view of the grip deck.

FIG. 3 shows a partial isometric corner view of the box springs with a corner view of the grip deck positioned on top of the box springs without the grip skirt panels.

FIG. 5 shows a side elevation section taken at 5—5 in FIG. 4 of the grip deck and grip skirt installed on the box springs.

FIG. 6 shows an optional corner grip skirt.

FIG. 7 shows detail of the corner grip skirt panel of FIG. 6.

FIG. 7A is a view of the corner grip skirt panel closed.

REFERENCE TO NUMERALS IN DRAWINGS

10 Mattress

12 Box springs

Figure 1:
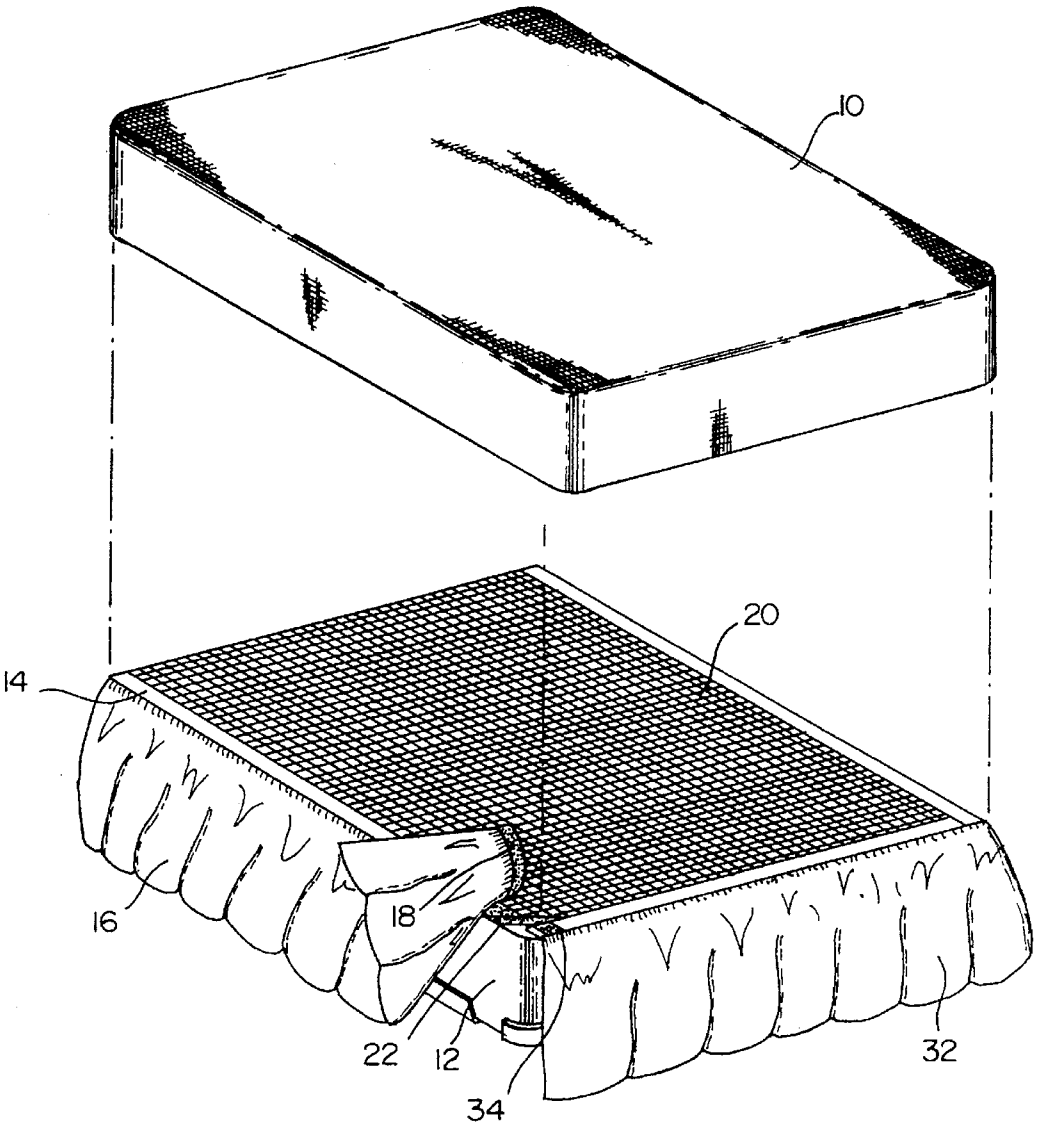
FIG. 1 shows conventional mattress and box springs the subject grip deck and grip skirt in a partially disassembled state.

14 Border of skirt panel attached to side grip skirt panel

16 Side grip skirt panel, including border

18 Fastener sewn to wrong side of side grip skirt panel border

20 A flexible, non-slip deck made from a friction-enhancing, non-slip material comprising a piece of fabric coated with a substance creating a surface with a coefficient of friction, and having fasteners attached to the perimeter of said deck

22 Fastener bonded and/or sewn to surface of non-slip grip deck made from a friction-enhancing, non-slip material comprising a piece of fabric coated with a substance creating a surface with a coefficient of friction, on three outer edges and two corner angles

24 Fastener bonded and/or sewn to surface of non-slip grip deck made from a friction-enhancing, non-slip material comprising a piece of fabric coated with a substance creating a surface with a coefficient of friction, on corner angle

26 Head (top end) of the non-slip grip deck made from a friction-enhancing, non-slip material comprising a piece of fabric coated with a substance creating a surface with a coefficient of friction

28 Foot (bottom end) of the non-slip grip deck made from a friction-enhancing, non-slip material comprising a piece of fabric coated with a substance creating a surface with a coefficient of friction

30 Sides (left and right) of the non-slip grip deck made from a friction-enhancing, non-slip material comprising a piece of fabric coated with a substance creating a surface with a coefficient of friction

32 Foot grip skirt panel, including border

34 Strip of fastener sewn to top right side of border on foot grip skirt panel

36 Right side of foot panel border

38 Corner grip skirt panel with border and fasteners

40 Fastener sewn and/or bonded to wrong side of corner panel border

42 Fastener sewn and/or bonded to right side of corner panel border

44 Border

46 Corner skirt panel attached to border

48 Corner border notch

50 Non-slip grip deck made from a friction-enhancing, non-slip material comprising a piece of fabric coated with a substance creating a surface with a coefficient of friction, with fastener bonded and/or sewn to four vertical outer edges

51 grip skirt panel for vertical application

52 Side grip skirt panel for vertical application

54 Foot grip skirt panel for vertical application

56 Continuous grip skirt panel for vertical application

58 Fastener sewn and/or bonded to non-slip grip deck made from a friction-enhancing, non-slip material comprising a piece of fabric coated with a substance creating a surface with a coefficient of friction

60 Stretch fastener sewn and/or bonded to fastener

62 Corner angle in vertical non-slip grip deck made from a friction-enhancing, non-slip material comprising a piece of fabric coated with a substance creating a surface with a coefficient of friction

64 Fastener sewn and/or bonded to right side of border

66 Wrong side of border

Description—FIGS. 1 to 9

A typical embodiment of the present invention is illustrated in FIG. 1. The grip deck 20 is placed on top of the box springs 12, the grip skirt side 16 and foot 32 panels are attached to the fastener 22 on the grip deck, and the mattress 10 is replaced on the box springs.

In the preferred embodiment, the grip deck is a non-slip fabric made from a friction-enhancing, non-slip material comprising a piece of fabric coated with a substance creating a surface with a coefficient of friction 20 (FIG. 2) with a strip of fastener 22 bonded and/or sewn to the surface of the friction-enhancing, non-slip material on three sides 28, 30 and two corner angles 24. The strip of side fastener 22 is angled to meet the strip of fastener on the corner angle 24, creating a continuous, usable fastener surface. When the grip deck 20 is placed on the box springs 12, with the grip deck head 26 placed facing the head or top of the bed, the corner angle 24 is automatically aligned into the correct position (FIG. 3) to allow a universal fit on the box springs within a size category (king, queen, full, twin, etc.).

The corner angle 24 and the angled attachment of the fastener sewn and/or bonded to the grip deck 20 at the corner is critical to the universal fit feature and ease of use (FIG. 3). Because the fastener is not being forced into a curve, the grip deck 20 lays flat upon the box springs 12.

Figure 4:
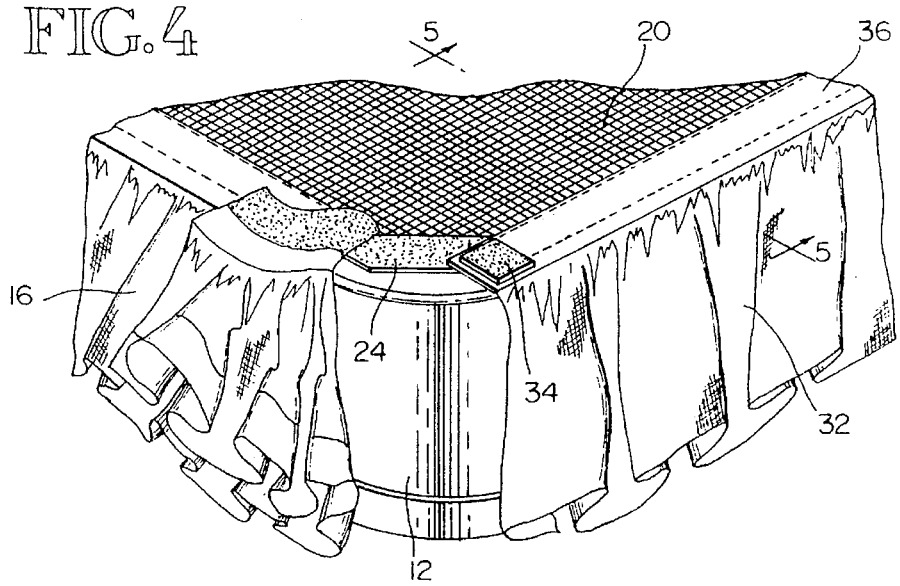
FIG. 4 shows a partial isometric corner view of the box springs with a corner view of the grip deck and a corner view of the grip skirt panel partially folded back, with a completely attached grip skirt foot panel.

To attach the skirt panels 16, 32 to the grip deck 20, the foot panel 32 is placed so that the fastener 18 touches the fastener 22 on the foot end 28 of the grip deck 20. Then the side panels 16 are placed so that the fasteners 18 touch the fastener 22 on the grip deck 20 sides 30 and attach to the fastener 34 on the top side of the foot panel 32 border 36 to complete the fastening (FIG. 4).

Figure 4A:
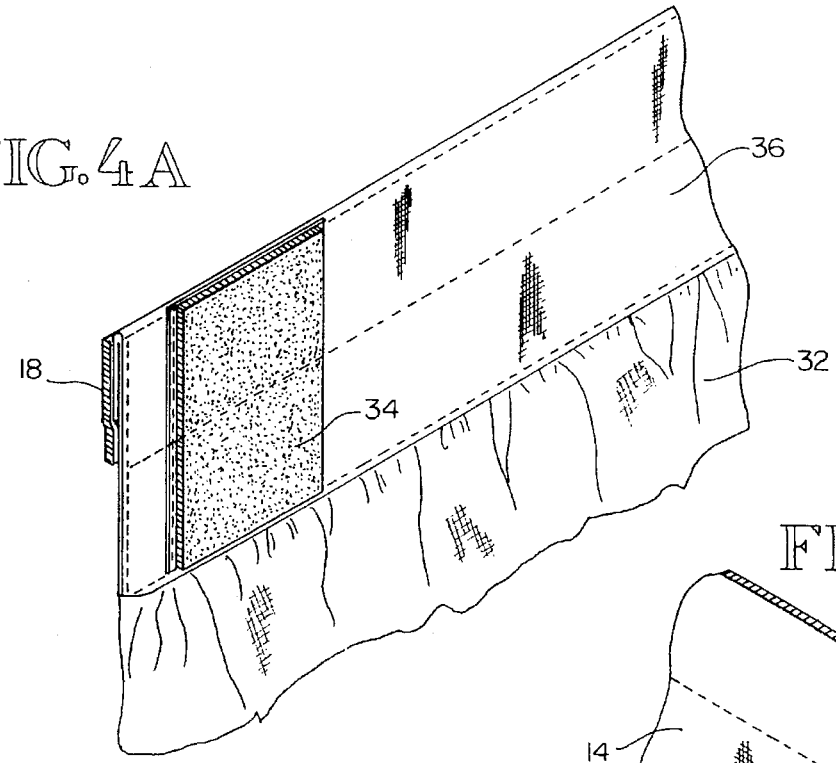
FIG. 4A shows foot panel grip skirt.

The foot panel grip skirt (FIG. 4A) piece has a strip of fastener 18 sewn and/or bonded to the underside of the border area 36 that is attached to the skirt 32 (the skirt pieces can be created in any number of styles: ruffled, pleated, box pleated, smooth, etc.) (FIG. 4A). On the top side (right side) of the foot panel grip skirt (FIG. 4A), a piece of fastener 34 is sewn and/or bonded to the foot panel border 36.

Figure 4B:
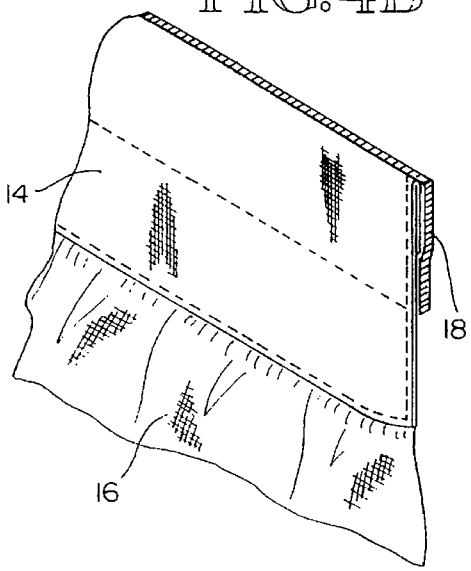
FIG. 4B shows side panel grip skirt.

The side panel grip skirt (FIG. 4B) piece has a strip of fastener 18 sewn and/or bonded to the underside of the border area 14 that is attached to the skirt piece 16.

A detail of the skirt panel 16 attached to the grip deck 20 fastener is shown in FIG. 5. The skirt panel 16 is vertical against the side of the box springs 12 and the skirt panel border 14 bent horizontally to meet the fastener 18 and fastened to the grip deck 20 fastener 22.

An alternative corner treatment is shown in FIGS. 6 and 7, where an additional skirt panel 38 is first attached to the corner angle 24 of the grip deck 20. The corner grip skirt panel 38 consists of a skirt piece 46 and border 44. The border 44 consists of a strip of fastener 40 sewn and/or bonded to the underside of the border 44; and a strip of fastener 42 sewn and/or bonded to the top side of the border 44. The border 44 also has a notch 48 that allows the corner panel border 44 to be configured into an angle appropriate for a universal corner fit and the corner panel skirt 46 to be fastened into place without the fabric warping or bunching; and also allows the panel 38 to be easily and universally fitted to any box springs 12.

FIGS. 8, 8A, 9 and 9A show an alternative embodiment for a vertical grip skirt application. The non-slip grip deck made from a friction-enhancing, non-slip material 50 has the band of fastener 58 sewn and/or bonded to four vertical outer edges, with the corner angle 62 and stretch fastener piece 60 that is sewn and/or bonded to the fastener 58, allowing for ease of installation and universal fit on box springs within each size category (king, queen, full, twin, etc.). The corner angle 62 and the stretch fastener piece 60 are critical to this embodiment.

Figure 8:
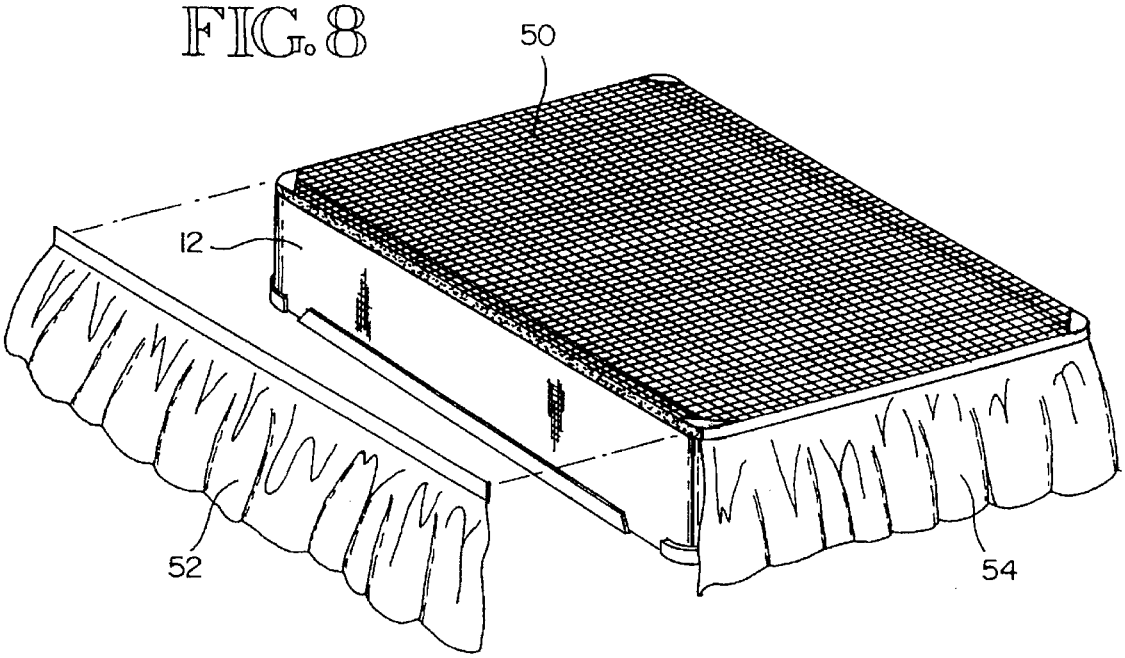
FIG. 8 illustrates an embodiment of the subject invention in which the grip panels are vertical.
Figure 8A:
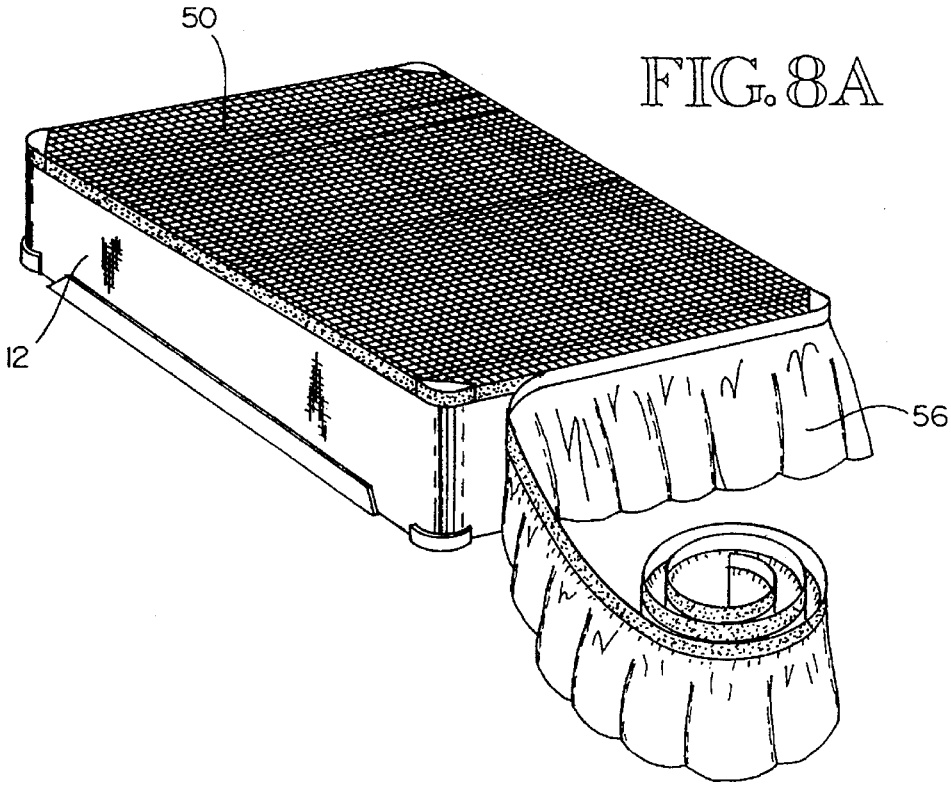
FIG. 8A shows the embodiment of FIG. 8 with a continuous skirt.

The skirts for the vertical grip deck 50 can be in three separate pieces (with optional fourth piece for head of bed) 52, 54 (FIG. 8) or one continuous piece 56 (FIG. 8A).

Figure 9:
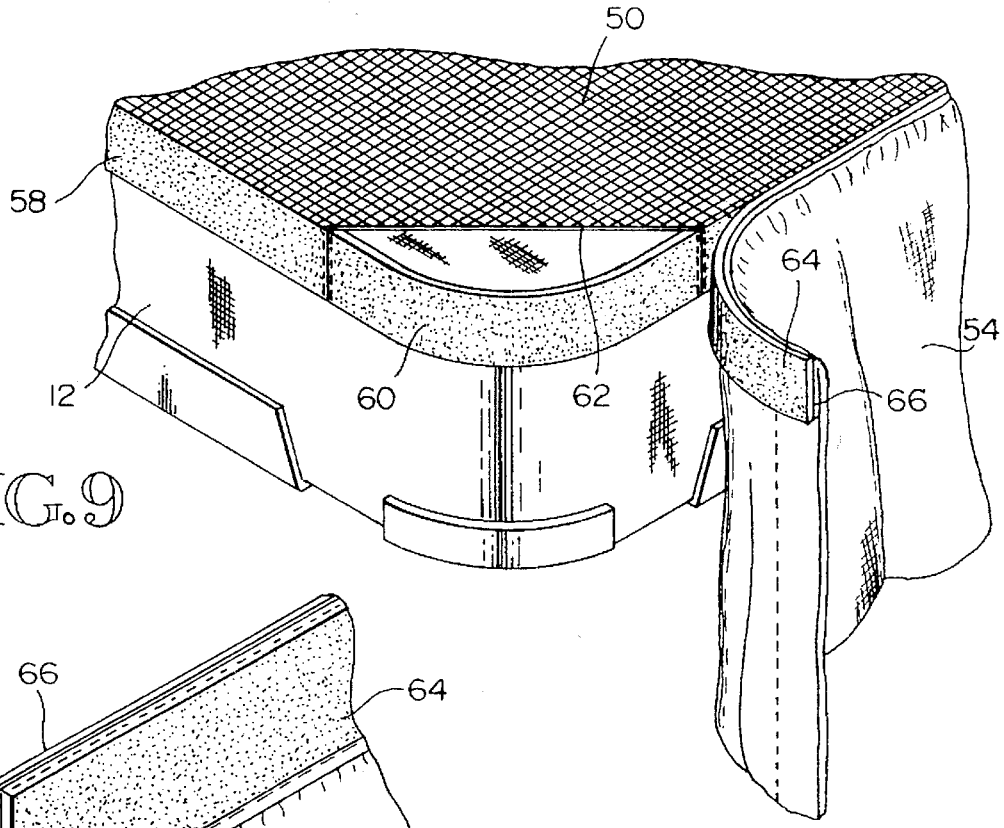
FIG. 9 shows a corner view of a vertical grip deck application.
Figure 9A:
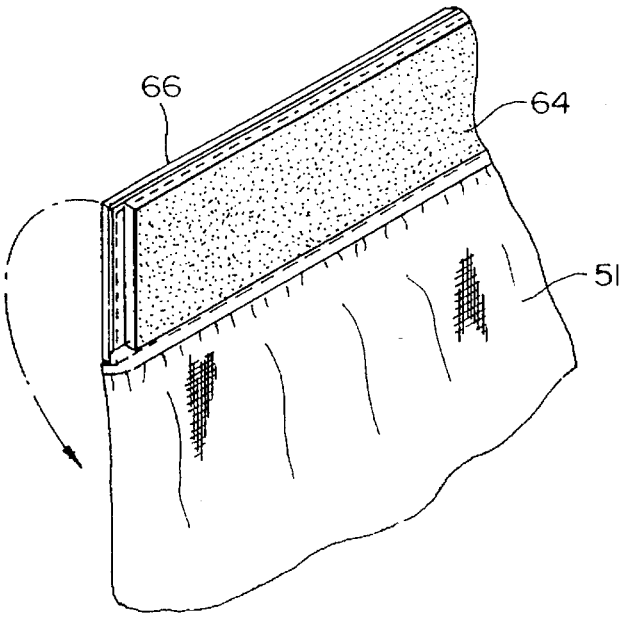
FIG. 9A shows the pieces of a vertical grip skirt.

FIG. 9A shows the skirt piece 51 with the attached fastener 64 sewn and/or bonded to the top side of the wrong side of the border 66.

When the skirt panel 52, 54 or 56 is attached to the fastener 58 on the vertical grip deck 50, the fastener 64 and border 66 is folded into a vertical position parallel with the skirt piece 51 and attached to the vertical fastener 58 (FIG. 9).

Foot grip skirt panel 54 is placed into position and attached to vertical fastener 58 first; then side grip skirt panels 52 are abutted to foot grip skirt panel 54 and attached to vertical fastener 58 (FIG. 8).

The continuous skirt panel 56 can also be used with this embodiment where the skirt 56 is in one piece and is fastened continuously to the vertical fastener 58 around the box springs 12. FIG. 8A.

From the description above, a number of advantages of my grip deck and grip skirts invention become evident:

(a) The grip deck made from a friction-enhancing, non-slip material comprising a piece of fabric coated with a substance creating a surface with a coefficient of friction, stabilizes the mattress on top of the box springs, eliminating all problems associated with the mattress slipping and sliding on top of the box springs.

(b) The grip deck will universally fit any box springs within a size category (king, queen, full, twin, etc.).

(c) The grip skirts allow for tremendous flexibility to fit any type of bedframe—with or without footboards and/or headboards—and the ability to quickly and easily achieve a "continuous" skirt appearance while accommodating footboards and/or headboards and/or bedframe legs.

(d) The strips of fastener allow for easy grip skirt height adjustment to accommodate differing bedframe heights, and since there is no need to match the fasteners "exactly" the grip skirts and grip deck are easier and faster to use.

(e) The construction shown with the corner angles in the grip deck and the notch in the corner panel grip skirt work with the inherent properties of the fastener. Consequently, there is no warping of the fastener strips which would preclude fastening the skirts properly.

Operation—FIGS. 1, 4, 7, 8, 8A, 9

The manner of using the grip deck and grip skirts is simple. For the horizontal embodiment (FIG. 1), the grip deck 20 is placed on the box springs with the angled corners aligned with the foot of the box springs 12 and the fastener facing up. Then the foot grip skirt 32 border with the fastener is attached to the foot of the grip deck. Next, the side panels 16 fastener is attached to the sides of the grip deck's 20 fastener. The fasteners do not need to match exactly at any point, as long as they meet enough to make a connection. This allows for individual adjustment in height and circumference and to accommodate the differences in each and every bed and/or bedframe. This is the universal fit feature. FIG. 4 shows how the end piece of the side panel 16 is attached to the piece of fastener 34 on the right side of the foot panel border 36. The installation is complete and the multi-panel skirts allow for height, circumference and bedframe style adjustments.

If the corner piece 46 is used, the corner pieces are attached to the grip deck 20 first closing the notch 48 to whatever degree is necessary to accommodate the corner angle of the box springs (FIG. 6), then the foot grip skirt 32 border is attached, and then the side grip skirts 16 are attached as described above.

The manner of using the vertical embodiment of the grip deck (FIG. 8) is also simple. The foot panel grip skirt 54 is applied first, then the side panel grip skirts 52 are attached, beginning at the corners abutting the foot panel grip skirt 54. To attach any of the vertical grip skirts, the border 66 is folded down towards the wrong side of the skirt 51 (FIG. 9A) placing the strip of fastener in a position to attach to the strip of fastener 58, 60 on the grip deck 50. Again, like the horizontal embodiment described above, the fasteners do not need to match exactly, but only enough to establish connection, allowing for flexibility and adjustment needed for any individual bed and/or bedframe, causing the universal fit.

SUMMARY, RAMIFICATIONS, AND SCOPE

Accordingly, the reader will see that the mattress grip deck and attachable multiple-piece or continuous grip skirts provide a total system that eliminates all the problems associated with bedskirts: mattress shifting, adjustability, difficulty of changing or cleaning bedskirts, and alignment of the bedskirts. Some of the advantages of the present invention are:

- it stabilizes the mattress on top of the box springs causing the box springs and mattress to function as a unit, i.e., no slipping or sliding or movement of the mattress on top of the box springs;
- the skirting materials will stay in place once they are attached because the mattress and box springs cannot slip and cause the skirting materials to become displaced
- the design and construction of the grip deck and grip skirt panels allow for individual variances in mattress and box springs within the standard sizes (twin, full, queen, king, etc.), creating a product that is truly universal within each size category
- the multiple-piece grip skirt panels provide an easy adjustment and fit to any bedframe type, with or without headboards, footboards, etc.
- the fasteners between the grip deck and grip skirt panels do not require an exact match or accuracy of alignment in order to attach to each other, allowing for ease of use and adjustability
- the multiple-piece grip skirt panels are easy to remove for cleaning or changing, and because the grip skirt panels are independent of each other, they can be removed individually as needed
- the style variations afforded by the flexibility of the grip skirt panels are unlimited, making it appealing to manufacturers, retailers, and the consumer Although the description above contains many specificities, these should not be construed as limiting the scope of the invention but as merely providing illustrations of some of the presently preferred embodiments of this invention. For example, the skirting material can be designed with ruffles, or smoothly tailored, or pleated, etc. The grip deck can be created using any non-slip fabrication.

Thus, the scope of the invention should be determined by the appended claims and their legal equivalents, rather than by the examples given.

I claim:

1. A bedskirt assembly for use on a bed, said bed comprising a box spring and a mattress, said bedskirt assembly comprising:

a flexible, non-slip deck made from a friction-enhancing, non-slip material, a skirt component and means for attaching said skirt component to said flexible, non-slip deck, said bedskirt assembly being installed on said bed by placing said flexible, non-slip deck on said box springs, placing said mattress on said flexible, non-slip deck and attaching said skirt component to said flexible, non-slip deck.

2. The bedskirt assembly of claim 1 comprising a plurality of said skirt components.

3. The bedskirt assembly of claim 1 in which said means for attaching comprises fastener components attached to said flexible, non-slip deck and said skirt component.

4. The bedskirt assembly of claim 2 in which said means for attaching comprises fastener components attached to said flexible, non-slip deck and said skirt components.

5. A bedskirt assembly for use on a bed, said bed comprising a box spring or supporting frame and a mattress supported on the upper surface of said box spring or supporting frame, and said bedskirt assembly comprising:

a flexible, non-slip deck made from a friction-enhancing, non-slip material comprising a piece of fabric coated with a substance creating a surface with a coefficient of friction, and having fasteners attached to the perimeter of said deck;

a skirt component and means for attaching said skirt component to said flexible, non-slip deck, said bedskirt assembly being installed on said bed by placing said flexible, non-slip deck on said box springs or supporting frame, placing said mattress on said flexible, non-slip deck and attaching said skirt component to said flexible, non-slip deck.

6. A combination as set forth in claim 5, wherein said skirt component is comprised of decorative fabric attached to a flat length of fabric comprising a top and bottom surface with fasteners attached to the bottom surface of said flat length of fabric.

7. A combination as set forth in claim 5, wherein said skirt component is comprised of decorative fabric attached to a flat length of fabric comprising a top and bottom surface with fasteners attached to the top and bottom surfaces of said flat length of fabric.

8. A combination as set forth in claim 5, wherein said skirt component is comprised of decorative fabric attached to a flat length of fabric comprising a top and bottom surface with fasteners attached to the top and bottom surfaces of said flat length of fabric and a V-notch cut away in the flat length of fabric.

* * * * *